US007441677B2

(12) United States Patent
Garcia

(10) Patent No.: US 7,441,677 B2
(45) Date of Patent: Oct. 28, 2008

(54) POUR SPOUT

(76) Inventor: Greg Garcia, 4200 Easton Dr., Ste. 12, Bakersfield, CA (US) 93309

( * ) Notice: Subject to any disclaimer, the term of this patent is extended or adjusted under 35 U.S.C. 154(b) by 473 days.

(21) Appl. No.: 11/325,960

(22) Filed: Jan. 4, 2006

(65) Prior Publication Data

US 2007/0151990 A1 Jul. 5, 2007

(51) Int. Cl.
*B67D 3/00* (2006.01)

(52) U.S. Cl. ..... 222/481.5; 222/478; 222/479; 215/307

(58) Field of Classification Search ..... 222/481.5, 222/482, 563, 566, 569, 552–555, 366.1, 222/367.1, 368; 215/307, 309
See application file for complete search history.

(56) References Cited

U.S. PATENT DOCUMENTS

| | | | | | |
|---|---|---|---|---|---|
| 1,520,845 | A | | 2/1924 | Baker | |
| 2,497,134 | A | * | 2/1950 | Muenze | 222/481 |
| 2,642,207 | A | * | 6/1953 | Renzi | 222/479 |
| 2,722,346 | A | | 11/1955 | Yokota | |
| 3,139,224 | A | * | 6/1964 | Bloom | 222/478 |
| 3,235,133 | A | * | 2/1966 | Zimmerman et al. | 222/478 |
| 3,321,113 | A | * | 5/1967 | Conry | 222/477 |
| 3,860,151 | A | | 1/1975 | Moen | |
| 3,868,051 | A | | 2/1975 | Goof | |
| 3,966,099 | A | * | 6/1976 | Sanford et al. | 222/478 |
| 4,222,504 | A | | 9/1980 | Ackerman | |
| 4,398,652 | A | * | 8/1983 | Ueda et al. | 222/1 |
| D279,169 | S | * | 6/1985 | Banasik | D9/447 |
| 5,211,318 | A | * | 5/1993 | Govatzidakis | 222/479 |
| 5,601,217 | A | | 2/1997 | Wagner | |
| 6,026,994 | A | | 2/2000 | Rigel | |
| 6,138,877 | A | | 10/2000 | Goff | |
| 6,230,944 | B1 | * | 5/2001 | Castellano et al. | 222/481.5 |
| 6,742,678 | B1 | | 6/2004 | Krystopik, Jr. | |
| 2005/0006418 | A1 | | 1/2005 | Rigel | |
| 2005/0011909 | A1 | | 1/2005 | Hanell | |
| 2005/0194410 | A1 | | 9/2005 | Pham | |

* cited by examiner

*Primary Examiner*—Lien T Ngo
(74) *Attorney, Agent, or Firm*—Dennis W. Beech

(57) ABSTRACT

The present invention may be used for insertion in and coupling with a neck of an open bottle that may have a fluid therein. A pour spout may have a conduit therethrough. A coupling portion of the pour spout may have a generally hollow cylindrical form that may form a portion of the conduit. An outer wall may have an intake flange at an intake end and an opening flange adjacent an annular lip member. The outer wall may have a flat portion and the intake flange may have a corresponding flat portion. A coupling sleeve may be disposed on the coupling portion. A discharge portion of the spout may have a generally half spherical member that may have a bore therethrough. The bore may form a portion of the conduit and the half spherical member may abut the annular lip member. The half spherical member and the opening flange may have a pressure equalization duct therethrough that may be parallel to and adjacent to said conduit. An exit opening of the pressure equalization duct may be positioned adjacent to the flat portion.

6 Claims, 1 Drawing Sheet

POUR SPOUT

BACKGROUND OF THE INVENTION

This invention relates to devices for insertion in and coupling with a neck of an open end of a bottle that may have a fluid or liquid therein. The pour spout may be used to discharge the liquid from the bottle. The new pour spout may have no sharp outer surfaces that may injure a user and the pour spout may have a low profile as compared to other pour spouts.

Pour spouts and pour devices may currently be used to control discharge of a liquid from a bottle. Generally these pour spouts may have a portion for insertion in a bottle open end and a second portion for the discharge of the liquid. The discharge end may commonly be a metal tube with a curve end to aid in pouring. The metal tube may protrude upwardly and may have sharp edges that may be dangerous for persons working in a bar as a pourer may catch a hand or arm on a sharp edge. While caps to cover a discharge end or a rounded upper portion of a discharge end may be used, these devices may generally be complicated structure that may be relatively expensive or cumbersome to use.

SUMMARY OF THE INVENTION

The present invention is directed to devices for insertion in and coupling with a neck of an open bottle that may have a fluid therein. A pour spout may have a conduit therethrough. A coupling portion of the pour spout may have a generally hollow cylindrical form that may form a portion of the conduit. An outer wall may have an intake flange at an intake end and an opening flange adjacent an annular lip member. The outer wall may have a flat portion and the intake flange may have a corresponding flat portion. A coupling sleeve may be disposed on the coupling portion. A discharge portion of the spout may have a generally half spherical member that may have a bore therethrough. The bore may form a portion of the conduit and the half spherical member may abut the annular lip member. The half spherical member and the opening flange may have a pressure equalization duct therethrough that may be parallel to and adjacent to said conduit. An exit opening of the pressure equalization duct may be positioned adjacent to the flat portion.

These and other features, aspects and advantages of the present invention will become better understood with reference to the following drawings, description and claims.

DETAILED DESCRIPTION

The following detailed description represents the best currently contemplated modes for carrying out the invention.

The description is not to be taken in a limiting sense, but is made merely for the purpose of illustrating the general principles of the invention.

Figure 1:
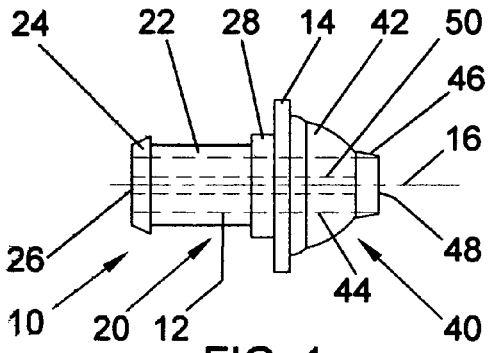
FIG. 1 illustrates a side view of the pour spout according to an embodiment of the invention.
Figure 2:
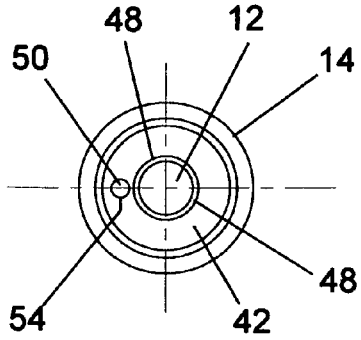
FIG. 2 illustrates a discharge end view of the pour spout according to an embodiment of the invention.
Figure 3:
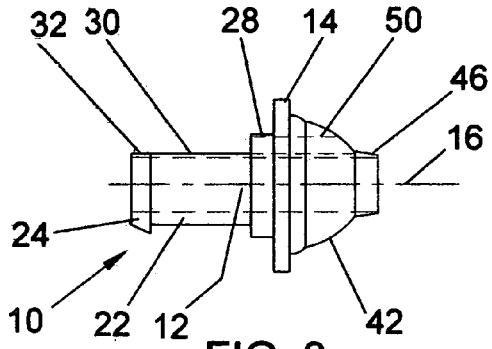
FIG. 3 illustrates a side view of the pour spout according to an embodiment of the invention.
Figure 4:
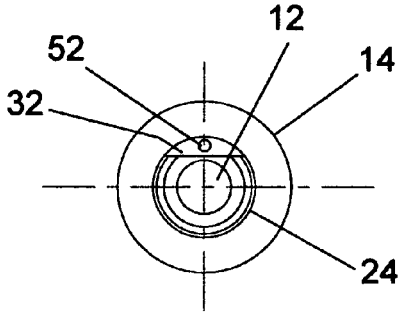
FIG. 4 illustrates a coupling end view of the pour spout according to an embodiment of the invention.
Figure 5:
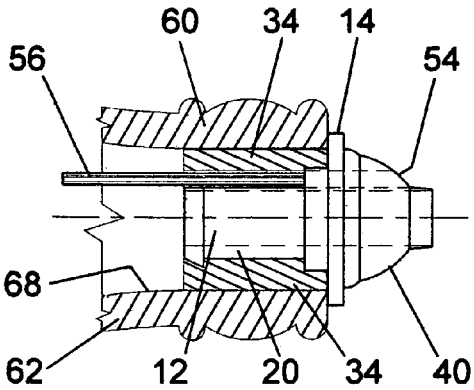
FIG. 5 illustrates a partial cross sectional view of the pour spout inserted in a bottle according to an embodiment of the invention.
Figure 6:
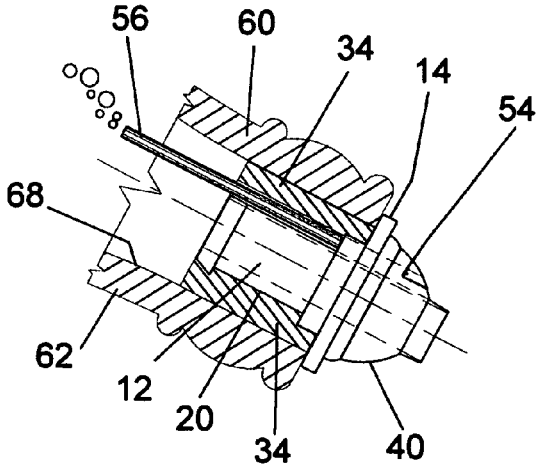
FIG. 6 illustrates a partial cross sectional view of the pour spout inserted in a bottle according to an embodiment of the invention.

Referring to FIGS. 1 through 6, a pour spout 10 may have a conduit 12 symmetrically formed about a centerline 16 with an intake end 26 and a discharge end 48. The pour spout 10 may be sized for insertion in and coupling with a neck of an open end 60 of a bottle 62 that may have a fluid 64 contained therein. The pour spout 10 may be retained in the open end 60 by a friction engagement of a coupling sleeve 34 against the interior wall 68 of the open end 60.

The pour spout 10 may have a coupling portion 20 that may have a generally hollow cylindrical form with the interior forming a portion of the conduit 12. An outer wall 22 may have an intake flange 24 adjacent the intake end 26 and an opening flange 28 adjacent an annular lip member 14. The flanges 24, 28 may aid in retaining the coupling sleeve 34 positioned on the coupling portion 20. The coupling sleeve 34 may be formed of a cork, rubber or like material suitable for insertion in and retention in an open bottle end 60.

The pour spout 10 may have a discharge portion 40 that may have a generally half spherical member 42 that may have a bore 44 therethrough. The half spherical member 42 may abut the annular lip member 14 and the bore 44 may form a portion of the conduit 12.

The half spherical member 42 and the opening flange 28 may have a pressure equalization duct 50 that may have an exit opening 52 and an inlet opening 54. The discharge portion 40 may have a flat portion 30 on the outer wall 22 and a corresponding flat portion 32 on the intake flange 24. The pressure equalization duct 50 may be parallel with and adjacent to the conduit 12 and the exit opening 52 may be positioned adjacent to the flat portion 30.

The discharge portion 40 may have a discharge duct 46 in communication with the bore 44. The discharge duct 46 may be centrally positioned and protrude from the half spherical member 42. The conduit 12 may have a cross section form that is circular, rectangular or other shape.

The annular lip member 14 may have a size larger than the opening in the bottle 62 for the annular lip member 14 to abut the lip 66 when the pour spout 10 may be inserted in the bottle open end 60.

The pour spout 10 structure may allow a bottle 62 having fluid 64 therein and pour spout 10 coupled to the open end 60 to be inverted to a generally vertical orientation with the pour spout 10 discharge end 48 oriented downwardly for pour of the fluid 64 from the bottle 62. There may be a pressure tube 56 attached to the exit opening 52 and positioned adjacent the flat portions 30, 32 as an air breather tube and to inhibit the coupling sleeve 34 from interfering with air flow into the bottle 62. The pressure tube 56 may be approximately three inches in length.

While the invention has been particularly shown and described with respect to the illustrated embodiments thereof, it will be understood by those skilled in the art that the foregoing and other changes in form and details may be made therein without departing from the spirit and scope of the invention.

I claim:

1. A device for insertion in and coupling with a neck of an open bottle having a fluid therein comprising:

a pour spout having a conduit therethrough;

a coupling portion of said pour spout having a generally hollow cylindrical form forming a portion of said conduit with an outer wall having an intake flange at an intake end and an opening flange adjacent an annular lip member;

said outer wall having a flat portion and said intake flange having a corresponding flat portion;

a coupling sleeve disposed on said coupling portion;

a discharge portion of said pour spout having a generally half spherical member having a bore therethrough forming a portion of said conduit and abutting said annular lip member; and said half spherical member and said opening flange having a pressure equalization duct therethrough parallel to and adjacent to said conduit wherein an exit opening of said pressure equalization duct disposed adjacent said flat portion.

2. The device as in claim 1 wherein said discharge portion having a discharge duct in communication with said bore that is centrally disposed and protruding from said half spherical member.

3. The device as in claim 2 wherein said discharge duct is generally hollow spherical form.

4. The device as in claim 1 wherein said conduit is generally symmetrically disposed about a centerline of said pour spout.

5. The device as in claim 1 wherein a pressure tube is attached to said exit opening and is disposed adjacent to said flat portion and said corresponding flat portion.

6. The device as in claim 5 wherein said pressure tube is approximately three inches in length.

* * * * *